US010278004B2

(12) United States Patent
Goldfarb

(10) Patent No.: US 10,278,004 B2
(45) Date of Patent: Apr. 30, 2019

(54) APPARATUS AND METHOD FOR A COMPLETE AUDIO SIGNAL

(71) Applicant: Barry Stephen Goldfarb, Deland, FL (US)

(72) Inventor: Barry Stephen Goldfarb, Deland, FL (US)

( * ) Notice: Subject to any disclaimer, the term of this patent is extended or adjusted under 35 U.S.C. 154(b) by 0 days.

(21) Appl. No.: 15/952,603

(22) Filed: Apr. 13, 2018

(65) Prior Publication Data

US 2018/0317039 A1 Nov. 1, 2018

Related U.S. Application Data

(60) Provisional application No. 62/492,529, filed on May 1, 2017.

(51) Int. Cl.
*H04S 5/00* (2006.01)
*H04S 7/00* (2006.01)

(52) U.S. Cl.
CPC ..... *H04S 7/307* (2013.01); *H04S 5/00* (2013.01); *H04S 2400/01* (2013.01); *H04S 2400/03* (2013.01); *H04S 2400/15* (2013.01); *H04S 2420/01* (2013.01)

(58) Field of Classification Search
CPC .. H04R 2420/07; H04R 1/1083; H04R 1/105; H04R 1/1091; H04R 2410/05; H04R 2499/13; H04R 3/04; H04R 5/033; H04R 1/1041; H04R 27/00; H04R 5/02; H04R 5/04; H04R 1/02; H04R 1/403; H04R 25/554; H04R 3/005; H04B 1/30; H04S 3/02; H04S 1/00; H04S 2420/01; H04S 3/00; H04S 3/008; H04S 1/002; H04S 1/005; H04S 5/02; H04W 88/02; H04W 52/0254; H04W 4/80; G10K 11/178; G10K 2210/1081; G10K 11/175; G10K 2210/3215
USPC ..... 381/17–23, 56–58, 119
See application file for complete search history.

(56) References Cited

U.S. PATENT DOCUMENTS 5,796,844 A * 8/1998 Griesinger ..... H04S 5/005 381/18
7,003,119 B1 * 2/2006 Arthur ..... H04S 3/02 381/17
8,259,960 B2 * 9/2012 Goldfarb ..... H04S 1/00 381/119
8,571,232 B2 * 10/2013 Goldfarb ..... H04H 60/04 381/119
2011/0158413 A1 * 6/2011 Goldfarb ..... H04H 60/04 381/1

* cited by examiner

*Primary Examiner* — Lun-See Lao
(74) *Attorney, Agent, or Firm* — William M. Hobby, III

(57) ABSTRACT

This invention relates to a circuit which enables even a single loudspeaker or audio channel to appear spatiotemporally as real to life. A discrete signal source with at least two discrete in-phase reference signals is split to form a first and second pair of signals. The second pair of signals is mixed to form one signal which is gain adjusted and then phase reversed before separately mixing with each of the first pair of reference signals to produce a pair of output signals. A monophonic signal source can be split to form the at least two discrete in-phase reference signals.

14 Claims, 1 Drawing Sheet

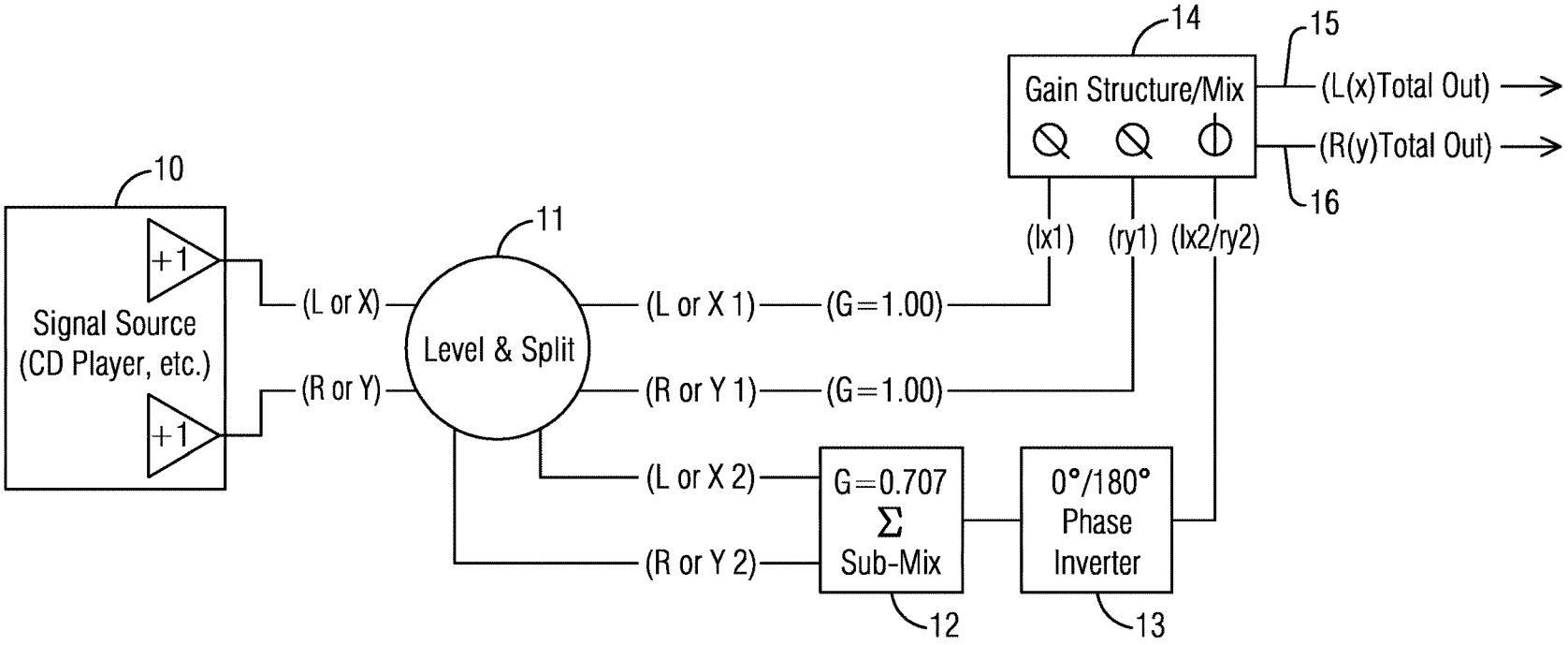
10
Signal Source
(CD Player, etc.)
+1
+1
(L or X)
(R or Y)
11
Level & Split
(L or X 1)
(R or Y 1)
(L or X 2)
(R or Y 2)
(G=1.00)
(G=1.00)
G=0.707
Σ
Sub-Mix
12
0°/180°
Phase
Inverter
13
14
Gain Structure/Mix
(Ix1)
(ry1)
(Ix2/ry2)
15
16
(L(x)Total Out)
(R(y)Total Out)

APPARATUS AND METHOD FOR A COMPLETE AUDIO SIGNAL

This application claims the benefit of U.S. Provisional Application No. 62/492,529, filed May 1, 2017.

FIELD OF THE INVENTION

The present invention relates to a method and apparatus for allowing an audio signal to present sound as it would be heard and experienced in the actual acoustical world.

BACKGROUND OF THE INVENTION

Present audio signals do not provide the correct ratio, alignment, or order for the sound components contained within an audio signal to be heard as we would hear them in nature. The purpose of the present invention is to enable those same sound components, consisting of magnitude, frequency and phase, already contained, but hidden, within every audio signal, set free, to be heard, and experienced in a similar and like way as we would hear them in nature.

Prior art has devised many ways of enhancing an audio signal to bring out certain spatial and temporal information found in nature, but rarely heard in an audio signal. Most of these "signal processors" use various techniques, such as Inter-aural Intensity Differences (IID), Inter-aural Time Differences (ITD), Head Related Transfer Function Algorithms (HRTF), and other analog and Digital Signal Processing techniques, (DSP), that either add, and or subtract, information to the audio signal that isn't actually there. Other prior art signal approaches try to avoid tampering with, or altering the signal by utilizing polar, or phase layering techniques, such as the author's U.S. Pat. No. 8,259,960, which shows that by having sections of frequencies set to 0° polar phase, and other sections of the spectral bandwidth set to 180° reversed polar phase, that one can begin to establish a substantially complete audio signal without altering, or tampering with the original signal. Other means of non-additive, or subtractive measures that do not change or alter the signal through artificial processing means include utilizing mid-side, coincident, and or a form of Sum and Difference signal processing. Many of these techniques are limited to microphone capture to enhance the signal in production, and not to the post production of the signal itself. Another one of the author's U.S. Pat. No. 8,571,232, shows a unique "golden ratio", based upon Ø. This ratio enables the quantity of spatiotemporal information within a signal to be heard closer to the way our ear-brain "hears". But these, and other non-invasive signal processing techniques, only work with stereo or multi-channel systems and are therefore limited.

An ideal signal solution, as presented herein, would operate independent of need for any additional channels or redundant duplicate signals outside of its own internal process. It would perform monophonically, and would have an obvious spatiotemporal, life like, 'presence' even when played through a single loudspeaker. This is extremely important, as there is no other prior art capable of delivering a realistic sound over a single speaker; or, as in the case of commercial background music sound, distributed to many speakers via a single monophonic signal source. In this particular case, the present invention, when used in its monophonic or distributive application, solves a problem. Rather than disappearing through acoustical phase shifts, to become part of the added "noise" in an environment, the present invention can be heard through the noise, at any volume level, and acts like an 'open-air-headphone', enabling a kind of acoustic privacy curtain between tables at a restaurant, or experiential theme parks, outdoor shopping areas, and other large and small sound application needs for public spaces.

At another extreme, and of additional importance, the present invention, when applied to the world of the musical arts, sound recordings, film, television, and other high value audio venues, is the fact that the present invention neither adds nor subtracts any information of any kind, from the signal that isn't already in the signal. There is no artificial 'effect' processing of any kind.

This is very important, as nothing should ever be added too, or subtracted from the final created content—master, film, or the like which the artist, musicians, and producers didn't put in when originally created. And this is all the more important when we are dealing with historical archival masters, where works have been locked away and stored for posterity, long after the artists have gone.

In this regard, the present invention allows us to hear and experience all of the original direct and ambient sound of every recording ever made. Whether mono, stereo, multi-channel, or encoded. The original masters already contain all of the physical information the present invention is able to provide. In many cases, the only people whoever heard all of the sound contained in these records, were the actual artists, "before the glass" of the recording studio.

Additionally, while it is well known since the early days of stereo-sound recording, when attempts were made by record-labels, and equipment manufacturers to maintain viability and sales for 'Mono' records, that various forms to modify mono recordings, in order to compete with stereo, were made and various approaches were taken under a variety of names, including "enhanced stereo", "pseudo-stereo", and others. These techniques varied, but generally fell into one of two main categories, as indicated by prior art. One type split the mono signal and used frequency differences between the two new signals. The other, more popular, used a phase shift on one channel, and a correction circuit to make up for the magnitude and spectral cancellations. Through this day, these techniques, which have become a standard for those familiar in the art are used to enhance mono and provide mono with a spatiotemporal illusion.

Aside from extreme and invasive signal "effect" processors and DSP's, the ability to extract unprocessed additional spatiotemporal information from a pair of signals relies on one form of sum and difference, or phase layered methodology for a stereo signal and for 'Mono', a frequency based difference signal, or phase shifting one channel, leaving the reference signal alone in both cases. These have become the "tricks of the prior art trade".

It is important to keep in mind that reversing polarity, or changing the quantities of L+/−R, and R+/−L will never impact mono. There are only two ways to impact mono for spatiotemporal 'effect' and, as mentioned, frequency signal processing, and/or phase reversal of one channel signal plotted against the reference signal.

The present invention is for a new approach to extract spatiotemporal information from a signal without concern as to whether or not it is mono, stereo, multi-channel, or even an encoded signal. It is agnostic to format and medium.

SUMMARY OF THE INVENTION

This invention relates to a circuit which uses a minimum of two discrete in-phase reference signals set either to left total and right total, (for two or more signals), or X, and Y, for one single (mono) signal, which enables even a single loudspeaker or audio channel to appear spatiotemporally as real to life as the actual acoustical, (or physical) event were occurring. An integral, or 'whole', 'complete', 'full', and 'completely occupied' signal, thereby has all of the phase, magnitude, and frequency that we hear and experience in the natural acoustical world.

An audio reproduction system has a discrete signal source outputting a pair of signals, such as a stereo output or a split monophonic signal. A splitter circuit is coupled to the discrete signal source for splitting each of the pair of discrete signals from the signal source into first and second pairs of signals. A mixer and gain circuit is coupled to said splitter circuit for receiving and mixing the second pair of signals to form a single combined signal output with an adjusted predetermined gain. A phase inverter circuit is coupled to the mixer and gain circuit for inverting the combined signal received from the mixer and gain circuit for an output mixer and gain circuit which is coupled to the splitter circuit for receiving the first pair of discrete signals and the inverted single combined signal and mixing the inverted single combined signal with each of the first pair of discrete signals and adjusting the gain of each mixed signal to produce a pair of output signals having an adjusted predetermined gain. The output mixer and gain circuit output signals have their gain in each of the pair of mixed output signals to within a range of plus or minus 18% of 0.702 gain.

An audio reproduction process selects a discrete signal source to output a pair of audio signals and splitting each of the pair of discrete signals into first and second pairs of signals. The second pair of signals is mixed to form a single combined signal which is adjusted for gain and phase inverted. The phase inverted combined second pair signal is then mixed with each of the first pair of discrete signals from the discrete signal source with said inverted single combined signal and the gain in each single combined signal adjusted to produce a pair of mixed output signals with an adjusted gain. The gain of each of said pair of mixed output signals is set to a gain of within a range of plus or minus 18% of 0.702 gain.

BRIEF DESCRIPTION OF THE DRAWINGS

The accompanying drawings, which are included to provide further understanding of the invention, are incorporated in and constitute a part of the specification and illustrate an embodiment of the invention and together with the description serve to explain the principles of the invention.

In the drawings:

The FIGURE is a circuit diagram of a preferred embodiment of the present invention.

DETAILED DESCRIPTION OF AN EXEMPLARY EMBODIMENT

Using a unique and novel approach of 'phase leveling', through gain structure (structural acoustics), a combination of power balancing, and phase layering, a ratio is defined which provides a source, or direct sound, with a shadow, phantom, or ambient sound. The balanced ratio of which closely aligns with the human auditory hearing system. The signal flow does not use any time delays or effects to manage this. The ratio of power balances, discrete, and summed circuits, and phase layers, (or shifts), are all that is needed. And these in turn, follow similar and like lines of the human signal process. The stereo channels herein are designated "R" for right and "L" for left while the split monophonic channels are designated "X" for left and "Y" for right.

A set of Right or Y discrete signals are set to a reference of either 0° or 180°. Ideally, you must first have a 'strike' sound, before we have an echo, or reflection, or rebound of that sound.

These signals have a matched gain setting, each representing G=1.00. For stereo, the left would be true left while the right would be true right. For a mono system, where the monophonic signal has first been split into two identical signals, one signal would be X, the other duplicate signal would be Y. Each of the signals mentioned would be "in-Phase".

A second set of duplicate signals Ly2 and Xy2, drawn from the reference signals, and identical in all respects, are summed. The summed signal is set to G=0.707, which is the square root of G=0.5. The new signal is phase shifted by 180° in the phase inverter 13 against the discrete Lx and Ry signals. The final 180° summed composite signal is sent into a gain circuit 14 and mixed with Lx1 and Ry1 to provide the final composite signal where Lx1 and Ry1 both having a gain of G=1.00. The signals are joined in the gain circuit 13 where Lx2 and Ry2, both=to 180° inversions of Lx1, and Ry1, are mixed using a ratio where the constant power of signal group has a slightly higher center image either as a phantom between two stereo speakers, or more importantly, between the 0° compression and the 180° rarefaction of a single, stand alone loudspeaker running through and by this ratio, and playing portions of both the 0° phase pattern, and the 180° phase pattern. This provides a similar and like four dimensional acoustical radiation pattern from a single source, as we would hear in nature. That is Lx1 and Ry1 at G=1.00 is juxtaposed with Lx2 and Ry2 at G=0.707 amplitude which is the square root of 0.5 constant.

There is a self balancing caused by this ratio as a natural outcome of this simple but elegant, and non-intuitive process, that provides both an enormous center image 1.414 having the effect of a strong compression without any compression being applied, and with an enormous width, that is life-like, and in some ways greater than any sum difference would allow without the signal sounding overly 'spacey', or resulting from an enhanced pseudo mono, caused by a channel shift in phase.

This "Method for a Phase Leveling Inversion Ratio" has the ability to provide an "Integral Signal Apparatus" without any difference in balance or need for frequency or magnitude correction of the phase being required, either between channels, or power balanced to a final composite signal. Further, the results impact Mono, Stereo, Multi-Channel and/or Encoded signals for voice, music, communications, and life sounds, across every application. The present invention accomplishes all this without any need for invasive signal processing which negatively impacts and alters the signal. It is as close to the way the human auditory system processes the sounds we hear in real life.

The present invention relates to a method and apparatus for allowing an audio signal to present sound as it would be heard and experienced in the actual acoustical (or physical) world. Hence, an acoustical audio signal. This includes both a primary signal and one or more redundant duplicate signals identical to, and split off from the primary signal, for the purpose of establishing levels of in-phase, (0° compression), and inverted phase (180° rarefaction), set to a similar and like ratio to how we hear, and experience sound as an acoustical event in nature. The circuit apparatus uses a minimum of two discrete in-phase reference signals set either to the left total and the right total for two or more signals or X, and Y, for one single (mono) signal, which enables even a single loudspeaker or audio channel to appear spatiotemporally as real to life as the actual acoustical, (or physical) event were occurring. Thereby providing an integral, or 'whole', 'complete', 'full', and 'completely occupied' signal, having all of the phase, magnitude, and frequency that we hear and experience in the natural acoustical world.

Referring to the circuit diagram in the FIGURE, the source signal 10 is where the signal flow begins. It can be a master tape, a digital file, a film strip, a phonograph, CD player, or the like. The signal source 10 will either need to have a standard two channel stereo signal output, or a monophonic output that will need to be duplicated into a second equal signal, and later leveled and split just as the stereo signal will be. The gain settings shown assume a typical standard 2v RMS output from the source. It is important that each channel has the same unity gain. The drawing shows a (+1) reference.

The output from the signal source 10 is shown as L=Left, or X output where X can be set up for mono duplication the same as Y, as opposed to right R. The signal output, L/X and R/Y, will each be in a relative reference phase—the example shown assumes a 0° in phase acoustic compression. The signal source 10 shows L or X, and R or Y, output heading into the splitter circuit 11 where the signal is gain output level adjusted. The gain output level may be adjusted by any means desired, including using an active pre-amp, passive control unit, mixer, variable means adjustment from the signal source itself, such as a headphone or variable line out, or the like. It is important to note that you can place an additional mixer, powered volume control, or the like at the output from the gain structure/mixer 14, the ideal embodiment would be one which has the signal flow integrity maintained by having the output 14 as the final output before directly inputting to the final recording, and/or amplifier, or the like. Additionally, the level sent to an amplifier or final record will be controlled by the level/splitter 11. So one familiar in the art will want to have enough boost or cut at this point to be able to drive any upstream device to the desired level. Not every device with a line level can support the weight placed on it, so two things are important: First is having enough level to boost the signal hot enough to reach any desired level at the end of the output circuit 14, and secondly, that the circuits employed throughout the remaining signal flow are designed to handle the levels that may be needed. You do need to make sure components are designed such as to avoid current and/or voltage clipping.

The second function of the level and splitter 11, is to act as a splitter. Meaning that for each one signal wire, two will be needed. So the splitter will act as a signal duplicator to enable a redundant second (or more) signal to be created. This can be done using a simple passive 'Y' splitter, or an active multi channel splitter. Hence, whereas level and splitter 11 input is L or X, and R or Y, its output has L, or X 1 or 2 outputs, and R, or Y 1 or 2 Outputs—shown as minimum.

The signal source 10 shows two sets of outputs. The first set, L or X 1, (LX1), and R or Y 1, (RY1) are shown where unity gain (+1), and their output is (theoretically) equal to the source but you may have some loss based upon chosen impedance matches or the like. But both LX1 and RY1 are discrete, each having their own independent channels into to the gain structure/mixer 14. The discrete channels are represented as the reference, or direct signals. Each one of the signals gain structure are ideally unity gain with one another, where (G=1.00).

The second outputs from the level/splitter show Lx2 and Ry2. These are sent to a 'Y' submixer for summing to mono in the submixer 12. In this circuit, the signal is made G=0.707. (or the square root of 0.5) and V 0.5. The new sum signal containing inclusively all of Lx2 and Ry2, properly balanced and all in phase, is sent to the phase inverter 13 where the 0° acoustic compression is inverted to 180° rarefaction. The final inverted signal is sent to the Gain structure/mixer 14.

Inside, the Gain structure/mixer 14, Lx1, is sent to its own discrete channel at G=1.00 while Ry1 is sent into its own discrete channel at G=1.00. Lx2/Ry2 is sent to its own discrete channel at G=0.702. This ratio is variable and can be tailored at will to provide a myriad of non-invasive signal processing techniques by altering the quantities of the ratios provided. However, there will be a minimum amount of variables, of approximately 18% in either direction, in order to closely match the proper balances of direct and ambient sound that would occur in an acoustic event. Inside the gain structure/mixer 14, Lx2/Ry2 is separately mixed with Lx1 to produce the output 15 (L(x) total out) and Ry2 to produce the output 16 (R(y)total out). In a monophonic signal source, a Y-connector or splitter splits the signal source 10 signal before it is fed into the level and splitter 11 to give the x and y input lines. The circuit output 15 and output 16 are the same in the monophonic system and either output 15 or 16 can be used for the monophonic output.

It should be clear at this time that a method and apparatus for allowing an audio signal to present sound as it would be heard and experienced in the actual acoustical or physical world has been provided. However the present invention is not to be considered limited to the forms shown which are to be considered illustrative rather than restrictive.

I claim:

1. An audio reproduction system comprising:

a discrete signal source outputting a pair of signals;

a splitter circuit coupled to said discrete signal source for splitting each of said pair of discrete signals from said signal source into a first and second pair of signals;

a mixer and gain circuit coupled to said splitter circuit for receiving and mixing said second pair of signals to form a single combined signal output having a predetermined gain;

a phase inverter circuit coupled to said mixer and gain circuit for inverting said combined signal received from said mixer and gain circuit; and an output mixer and gain circuit coupled to said splitter circuit for receiving said first pair of discrete signals and said inverted single combined signal and mixing said inverted single combined signal with each of said first pair of discrete signals and adjusting the gain of each said mixed signals to produce a pair of output signals having a predetermined gain within a range of 18% of 0.702 gain;

thereby generating an improved audio signal.

2. The audio reproduction system in accordance with claim 1 in which the gain of each of said pair of mixed output signals is set to about 0.702 gain.

3. The audio reproduction process in accordance with claim 1 in which the gain of said combined signal gain adjustment is set to about 0.707.

4. The audio reproduction system in accordance with claim 1 in which said selected discrete signal source is a monophonic signal source split to output said pair of audio signals from said discrete signal source.

5. The audio reproduction system in accordance with claim 4 in which each of said pair of output signals is a monophonic signal.

6. The audio reproduction system in accordance with claim 1 in which said selected discrete signal source is a stereophonic signal source.

7. An audio reproduction process comprising the steps of:

selecting a discrete signal source;

outputting a pair of audio signals from said discrete signal source;

splitting each of said pair of discrete signals from said signal source into first and second pairs of signals;

mixing said second pair of signals to form a single combined signal output:

adjusting the gain of said single combined signals to a predetermined gain within a range of plus or minus 18% of 0.702 gain;

phase inverting said single combined signal;

mixing each of said first pair of discrete signals with said inverted single combined signal to produce a pair of mixed output signals; and adjusting the gain of each of said pair of mixed output signals to produce a pair of output signals having a predetermined gain.

8. The audio reproduction process in accordance with claim 7 in which the gain of each of said pair of mixed output signals is set to a gain of about 0.702 gain.

9. The audio reproduction process in accordance with claim 7 in which the gain of said single combined signal gain adjustment is set to about 0.707 gain.

10. The audio reproduction process in accordance with claim 7 in which said selected discrete signal source is a split monophonic signal source outputting said pair of split monophonic signals from said discrete signal source.

11. The audio reproduction process in accordance with claim 10 in which each of said pair of output signals is a monophonic signal.

12. An audio reproduction process comprising the steps of:

selecting a discrete monophonic signal source;

splitting the selected discrete monophonic signal source in a pair of discrete monophonic signals;

outputting said pair of monophonic audio signals from said discrete signal source;

splitting each of said pair of monophonic discrete signals from said monophonic signal source into first and second pairs of monophonic signals;

mixing said second pair of monophonic signals to form a single combined signal output:

adjusting the gain of said single combined signal for a gain of within a range of plus or minus 18% of 0.702 gain;

phase inverting said single combined signal;

mixing each of said first pair of monophonic discrete signals with said inverted single combined signal to produce a pair of mixed output monophonic signals; and adjusting the gain of at least one of said pair of mixed output signals to produce at least one monophonic output signal having a predetermined gain.

13. The audio reproduction process in accordance with claim 12 in which the gain of said at least one monophonic output signal is set to a gain of about 0.702 gain.

14. The audio reproduction process in accordance with claim 12 in which the gain of said single combined signal gain adjustment is set to about 0.707 gain.

* * * * *